US007464671B2

(12) United States Patent
Harth, III

(10) Patent No.: US 7,464,671 B2
(45) Date of Patent: Dec. 16, 2008

(54) HEAT EXCHANGER FRAMEWORK

(75) Inventor: George H. Harth, III, Wadsworth, OH (US)

(73) Assignee: Babcock & Wilcox Power Generation Group, Inc.

( * ) Notice: Subject to any disclaimer, the term of this patent is extended or adjusted under 35 U.S.C. 154(b) by 110 days.

(21) Appl. No.: 11/487,624

(22) Filed: Jul. 17, 2006

(65) Prior Publication Data

US 2008/0022949 A1 Jan. 31, 2008

(51) Int. Cl.
*F22B 37/24* (2006.01)

(52) U.S. Cl. ..... 122/510; 122/511; 376/462; 165/162

(58) Field of Classification Search ..... 122/510, 122/511, 235.23, 265, 268; 376/462, 438; 248/68.1; 110/325; 165/69, 82, 162
See application file for complete search history.

(56) References Cited

U.S. PATENT DOCUMENTS 2,140,279 A * 12/1938 Buell ..... 122/478
4,123,994 A * 11/1978 Gersch et al. ..... 122/6 A
4,337,827 A * 7/1982 Jabsen ..... 165/172
4,480,594 A * 11/1984 Sullivan et al. ..... 122/510
4,637,455 A * 1/1987 Tordonato ..... 165/104.16
4,738,225 A * 4/1988 Juang ..... 122/367.3
6,178,926 B1 * 1/2001 Worman ..... 122/510
6,244,330 B1 * 6/2001 Eisinger et al. ..... 165/69

* cited by examiner

*Primary Examiner*—Gregory A Wilson
(74) *Attorney, Agent, or Firm*—Eric Marich; Michael J. Seymour

(57) ABSTRACT

A structural framework for supporting the heat exchanger of a steam generator, the former being comprised of serpentine tubes having sloped segments to facilitate the drainage of water from the heat exchanger when the steam generator is shutdown. The structural framework includes paired groups of vertically and diagonally extending first support members contiguously straddling the sloped-tube segments. The paired first support members are rigidly connected by second support members which extend between adjacent sloped-tube segments. The structural framework preserves the spacing between the sloped-tube segments and prevents direct contact between adjoining tube surfaces, but is not attached to the straddled tube segments and, thus, provides a tube supporting fit that is loose enough to permit the tubes to move freely due to expansion and contraction at different rates from that of the structural framework.

22 Claims, 3 Drawing Sheets

HEAT EXCHANGER FRAMEWORK

FIELD AND BACKGROUND OF THE INVENTION

The present invention relates, in general, to serpentine type tubular heat exchangers located in the vertical gas passageways of steam generators, and more particularly, to the structure and support of the serpentine oriented tubes to cause the drainage of fluid collected therein when the steam generators are shutdown.

It is common practice in the design of a modern high capacity steam generator to provide heat exchange surfaces in the form of closely spaced serpentine metal tube rows disposed in a vertical passageway through which combustion gases at relatively high velocities are conveyed, with the metal tubes in each row having horizontally extending segments conveying the fluid being heated, and being arranged in spaced parallel rows distributed transversely of the direction of gas flow.

Whenever the steam generator is shutdown, water collects along the horizontally extending segments of the heat exchanger tubes. The retention of water in the tubes after a steam generator has been shutdown, if unremoved, will lead to metal pitting corrosion and eventual tube failure if their walls become too thin as a result of the corrosion. Such an event is very costly since it requires the replacement of the weakened or failed tubes thereby resulting in down time of the steam generator.

Pitting corrosion is a localized form of corrosion by which cavities or holes are produced in a metal. Pitting is commonly observed on surfaces with little or no general corrosion. Pitting corrosion is generally of greater concern than uniform corrosion because it is more difficult to detect and protect against. Corrosion products often cover the pits, making them difficult to identify. Apart from localized loss of thickness at the tube metal surface, corrosion pits can also be harmful by acting as stress risers. Corrosion pits are commonly the starting points for cracking and fatigue.

An extremely corrosive microenvironment typically forms within a corrosion pit that varies considerably from the bulk corrosive environment. This corrosive microenvironment can hasten growth of pits once initially formed. Pitting corrosion can produce pits in a variety of configurations. For example, open pits may be formed, or pits may be covered with a semi-permeable skin comprising corrosive products. Pits can be hemispherical or cup-shaped, flat-walled, or completely irregular in shape. Pits may also reveal the crystal structure of the tube metal. Through-shaped pits may be narrow and deep or shallow and wide. Sideways pits may be sub surface, undercutting, or attack the grain of the metal horizontally.

The corrosion problem is exacerbated at locations where attachment welds are made to the heat exchanger tubing, such as with the supports used to maintain the tubes and tube rows of a heat exchanger tube bank in coplanar spaced-apart and parallel relation. The heat affected zones of the attachment welds are prone to pitting corrosion. Weld attachments are also known to restrict the thermal expansion and contraction of the tubing and thus cause it to distort or sag, such that low spots are formed in the horizontal runs of the tubing. These low spots collect water after the steam generator is shutdown and are susceptible to pitting corrosion.

SUMMARY OF THE INVENTION

The pitting corrosion experienced as a result of the retention of water in the horizontal segments of the heat exchanger tubes, subsequent to the shutdown of a steam generator, is largely overcome by the novel heat exchanger structural framework of the present invention. This framework is applicable to a heat exchanger having at least one bank of spaced serpentine fluid conveying tube rows disposed within a vertical passageway of the steam generator in side-by-side parallel relation across the gas stream which is flowing through the passageway. Each of the tube rows includes spaced and substantially coplanar elongate sloped-tube segments and return-bend tube segments. The sloped-tube segments replace the prior art horizontal tube segments and thus greatly facilitate the drainage of water from the heat exchanger when the steam generator is shutdown.

In accordance with the heat exchanger structural frameworks of the present invention, the bank of serpentine tubes is supported in a manner which will allow thermal expansion and contraction to take place without causing the tubing to distort or sag and thus form low spots that are apt to collect water when the steam generator is shutdown. The structural frameworks include paired groups of vertically and diagonally extending first support members contiguously straddling the sloped-tube segments. The vertical structural frameworks are formed of paired vertically extending first support members that are rigidly connected by second support members or lateral cross bars which extend between the straddled sloped-tube segments. The diagonal structural frameworks are formed of paired diagonally extending first support members that are rigidly connected by second support members or lateral compression supports which extend between the straddled sloped-tube segments. The diagonal structural frameworks transmit the heat exchanger support loads to the walls of the vertical passageway housing the heat exchanger. The structural frameworks preserve the spacing between the sloped-tube segments and prevent direct contact between adjoining tube surfaces, but are not attached to the straddled tube segments and thus provide a tube supporting fit that is loose enough to permit the tubes to move freely due to thermal expansion and contraction at different rates from that of the structural frameworks, thereby preventing the distortion and sagging of tubes and the formation of water collecting low spots.

These and other features and advantages of the present invention will be better understood and its advantages will be more readily appreciated from the detailed description of the preferred embodiment, especially when read with reference to the accompanying drawings.

DESCRIPTION OF THE PREFERRED EMBODIMENT

Figure 1:
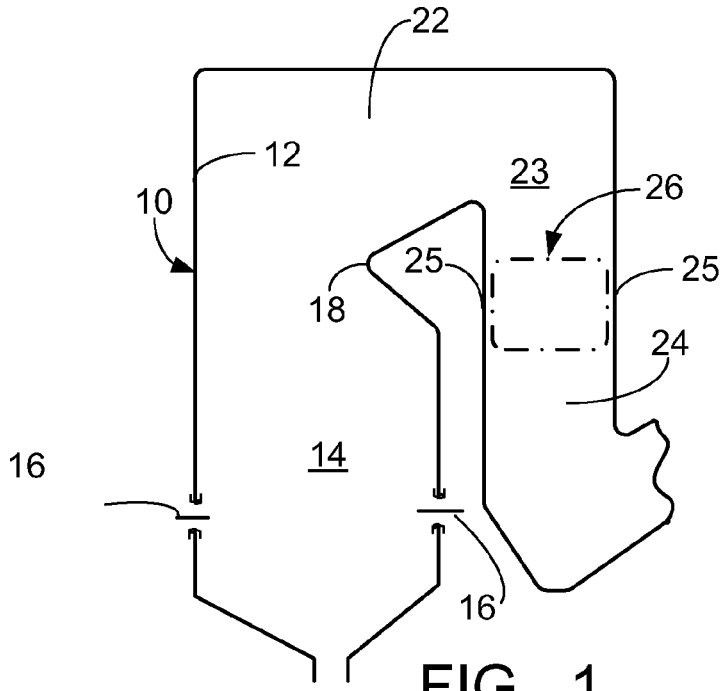
FIG. 1 is a schematic sectional side view of a steam generator including a heat exchanger embodying the present invention.

Reference will hereinafter be made to the accompanying drawings wherein like reference numerals throughout the various figures denote like elements.

Referring to FIG. 1, there is shown a steam generator 10 including water cooled tubular walls 12 that define a furnace chamber or combustion space 14 to which a fuel and air mixture is supplied by burners as schematically shown at 16. After combustion has been completed in the furnace chamber 14, the hot gases flow upwardly and around the furnace chamber nose portion 18, and across through the horizontal section 22 of the convection passageway 23, and thence downwardly through the vertical section 24 of the convection passageway 23 which is defined by walls 25 and includes a heat exchanger such as the primary superheater 26. Usually, the gases leaving the vertical section 24 of the convection passageway 23 flow through an air heater, not shown, and thence through a gas clean-up system, not shown, and are thereafter discharged through a stack, not shown.

Figure 3:
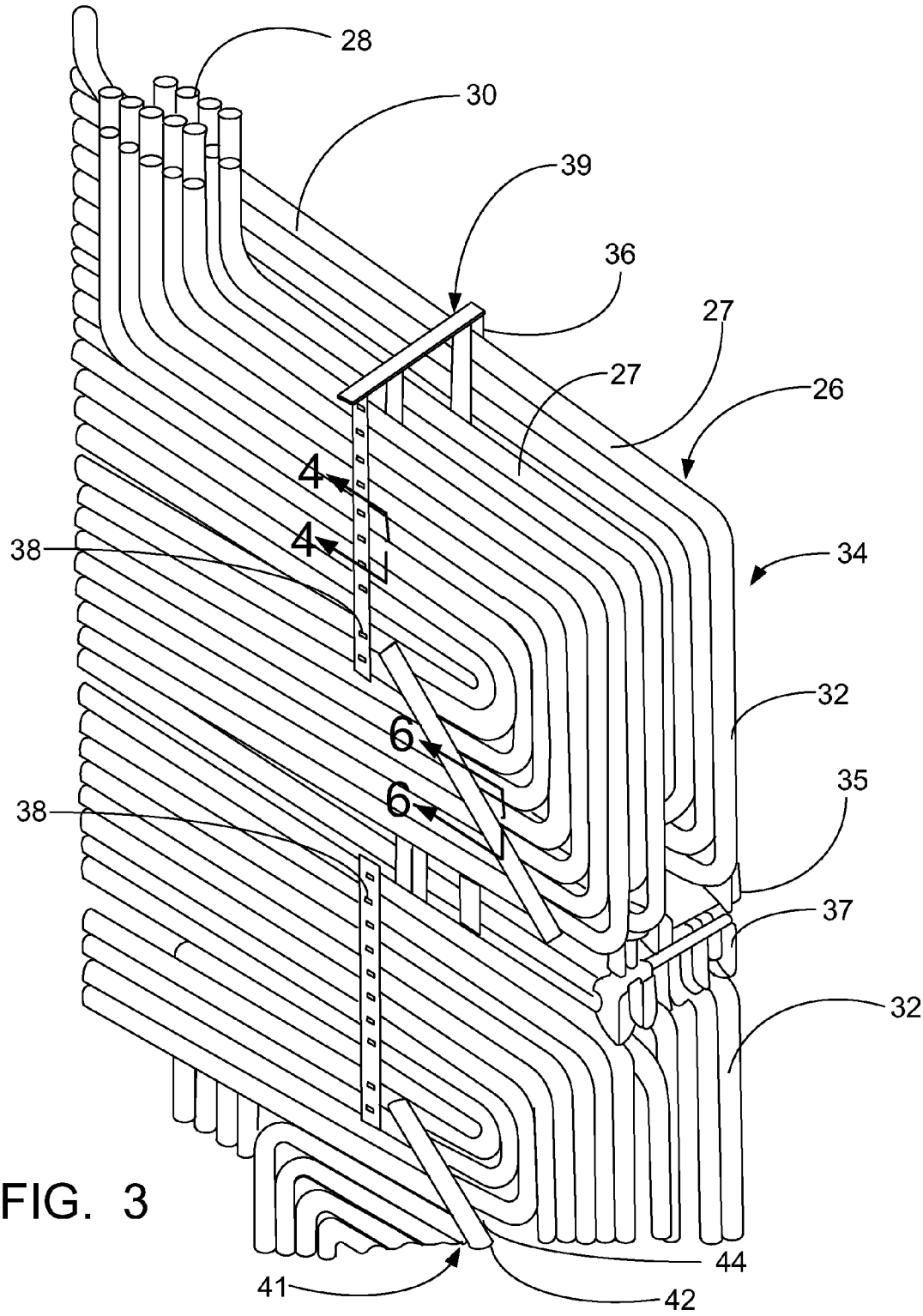
FIG. 3 is a fragmented, perspective view of the heat exchanger tube banks and support members.

It will be understood that in accordance with well known practice, the heat exchanger 26 includes banked rows 27 of spaced serpentine tubes 28, as shown in FIG. 3, extending across the width of the vertical section 24 of the convection passageway 23, and arranged for fluid flow therethrough and in indirect heat exchange with the combustion gases flowing through the vertical section or passageway 24.

Figure 2:
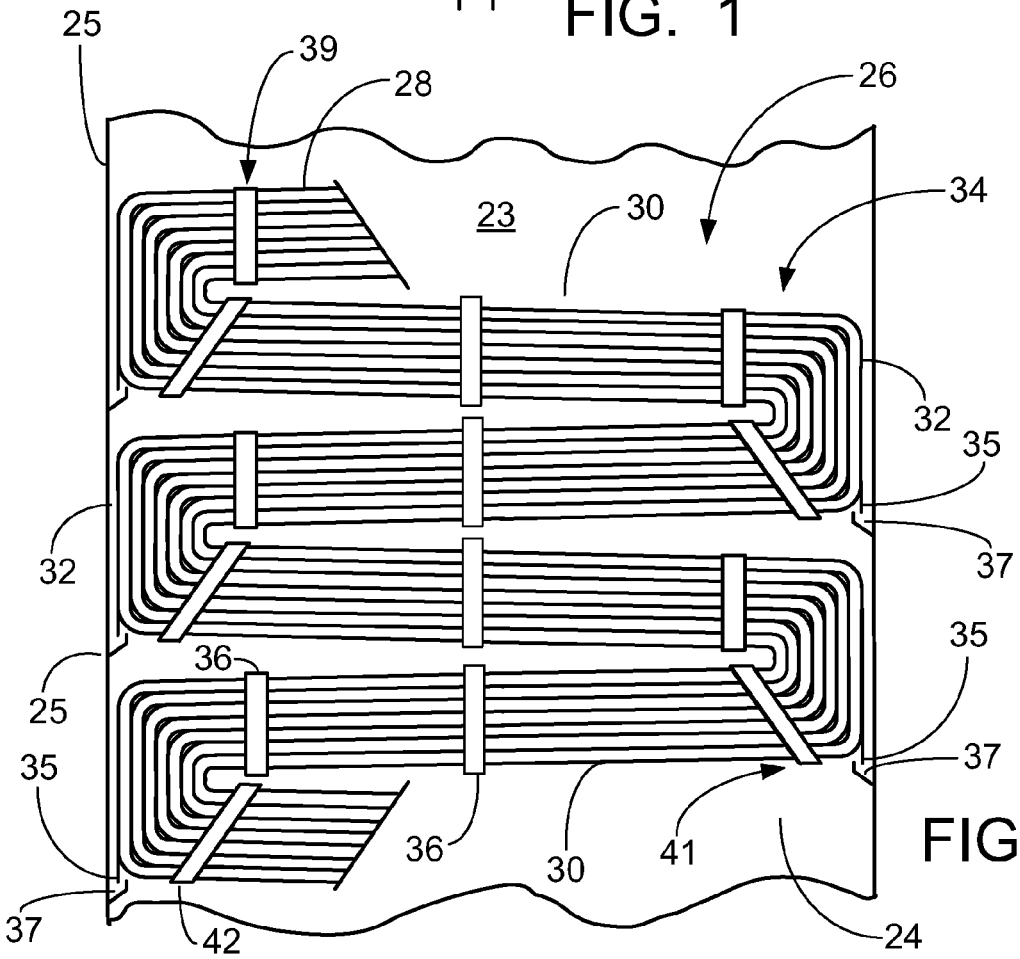
FIG. 2 is a fragmented, sectional side view of the heat exchanger, and its tube banks and support members.

Referring to FIGS. 2 and 3, there are shown fragmented sectional side and perspective views, respectively, of a heat exchanger 26 including a plurality of serpentine tubes 28 disposed in side-by-side parallel relation to one another, as shown in FIG. 3, and across the gas stream which is flowing through the vertical section 24 of the convection passageway 23, as shown in FIGS. 1 and 2, and with each serpentine tube 28 having elongate sloped-tube segments 30 and return-bend tube segments 32 forming the rows 27 of tube banks 34. In accordance with the invention, the elongated tube segments 30 of the serpentine tubes 28 extend at an angle downwardly from the horizontal to cause fluid to be drained from the serpentine tubes 28 when the steam generator 10, shown in FIG. 1, is shutdown.

The serpentine tubes 28 of heat exchanger 26 are supported by vertically extending structural frameworks 39 and diagonally extending structural frameworks 41. The heat exchanger 26 is itself supported by the walls 25, shown in FIGS. 1 and 2, by way of the first support lugs 35 which are rigidly connected, preferably by welding, to the lower end of the outermost return-bend tube segment 32 of each tube bank 34 and slidably engaged with the second support lugs 37, the latter being rigidly connected, preferably by welding, to the walls 25. The diagonally extending structural frameworks 41 are located closest to the return-bend segments 32 and transmit the heat exchanger 26 support loads to the first support lugs 35 which, in turn, transmit the support loads to the second support lugs 37 and thence onto the walls 25 of vertical passageway 24.

The vertically extending structural framework 39 includes first support members 36 which are generally in the form of vertically extending bars or plates that are paired to contiguously straddle the sloped-tube segments 30, and second support members 38, shown in FIG. 3, which are generally in the form of laterally extending cross bars or plates which run between the straddled sloped-tube segments 30.

The vertically extending first support members 36 are rigidly attached to or connected with the laterally extending second support members 38, preferably by welding, to insure that the latter remain tightly drawn against the straddled sloped-tube segments 30, while preserving the spacing between the sloped-tube segments 30 and preventing direct contact between adjoining tube surfaces. In accordance with the invention, the rigidly interconnected first and second support members 36 and 38, respectively, are not welded or otherwise attached to the serpentine tubes 28, thereby creating a structural framework 39 which provides a tube supporting fit that is loose enough to permit relative thermal expansion and contraction of the serpentine tubes 28 and the framework 39, the latter being comprised of the first and second support members 36 and 38, respectively.

The diagonally extending structural framework 41 includes first support members 42 which are generally in the form of diagonally extending bars or plates that are paired to contiguously straddle the sloped-tube segments 30, and second support members or compression supports 44, shown in FIG. 3, which are generally in the form of laterally extending blocks that run between the straddled sloped-tube segments 30, and are contoured to engage the adjacent surfaces of the sloped-tube segments 30.

The compression supports 44 are rigidly secured to the paired diagonally extending first support members 42, preferably by welding, to insure that the latter remain tightly drawn against the straddled sloped-tube segments 30, while preserving the spacing between the sloped-tube segments 30, and preventing direct contact between adjoining tube surfaces, and also transmitting the heat exchanger 26 support loads from the first support lugs 35 to the second support lugs 37 and hence to the walls 25 which form the vertical section 24 of the convection passageway 23. In accordance with the invention, the rigidly interconnected first and second support members or compression supports 42 and 44, respectively, are not welded or otherwise attached to the serpentine tubes 28, thereby creating a structural framework 41 which provides a heat exchanger and tube supporting fit that is loose enough to permit relative thermal expansion and contraction of the serpentine tubes 28 and the framework 41, the latter being comprised of the first and second support members 42 and 44.

Figure 4:
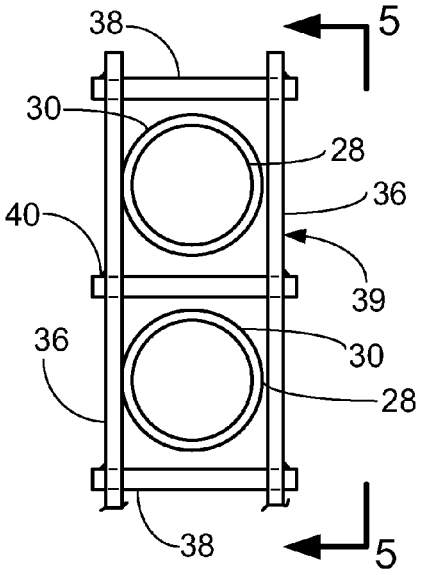
FIG. 4 is a fragmented, enlarged sectional view of the vertical support members and the lateral cross bars taken along line 4-4 of FIG. 3.
Figure 5:
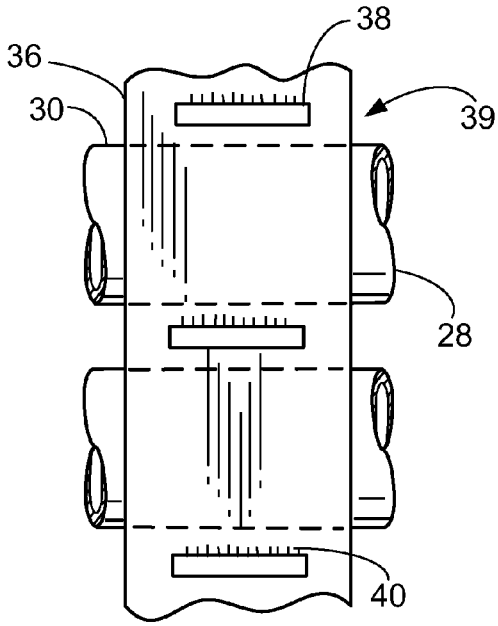
FIG. 5 is a fragmented, enlarged side view of the vertical support members and the lateral cross bars taken along line 5-5 of FIG. 4.

Referring to FIGS. 4 and 5 there are shown fragmented, enlarged sectional and side views of the vertically extending first support members 36 and the laterally extending second support members or cross bars 38. The paired first support members 36 straddle the sloped-tube segments 30 of the serpentine tubes 28. The first support members 36 are drawn tightly against the sloped-tube segments 30 and are rigidly maintained in that position by the second support members or cross bars 38, which are rigidly attached to the first support members 36 by welds 40. The vertically extending structural framework 39 formed by the first support members 36 and the second support members 38 preserves the spacing between the sloped-tube segments 30 and prevents direct contact between adjoining tube surfaces, but is not attached to the straddled sloped-tube segments 30 and is loose enough to allow the serpentine tubes 28 and the structural framework 39 to move freely in response to thermal expansion and contraction.

Figure 6:
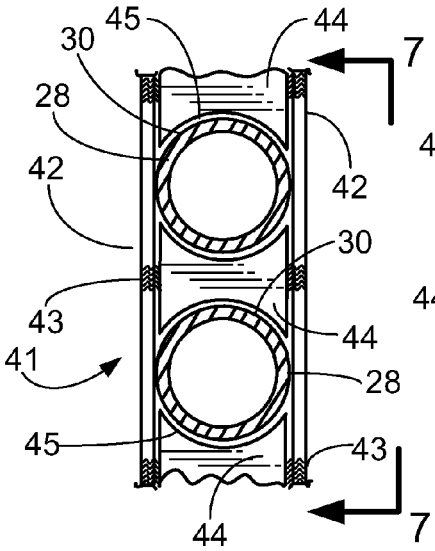
FIG. 6 is a fragmented, enlarged sectional view of the diagonal support members and the lateral compression supports taken along line 6-6 of FIG. 3.
Figure 7:
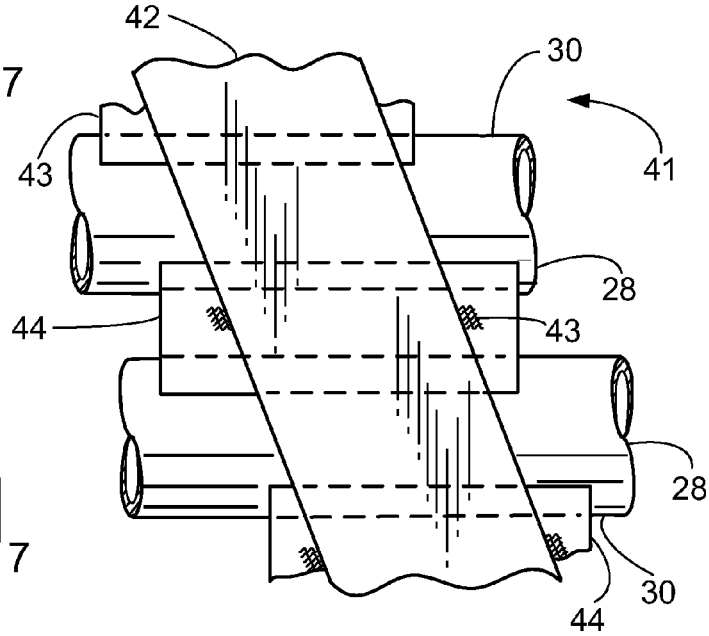
FIG. 7 is a fragmented, enlarged side view of the diagonal support members and the lateral compression supports taken along line 7-7 of FIG. 6.

Referring to FIGS. 6 and 7 there are shown fragmented, enlarged sectional and side views of the diagonally extending first support members 42 and the laterally extending second support members or compression supports 44. The first support members 42 are drawn tightly against the sloped-tube segments 30 and are maintained in that position by the second support members or compression supports 44, which are rigidly attached to the first support members 42 by welds 43. The second support members or compression supports 44 are formed as a solid block of concavo-concave cross-sectional configuration so as to have the concave recesses 45 engage the contiguous portion of the adjacent sloped-tube segments 30, as shown in FIG. 7, and thereby support the serpentine tube 28 off the first support members 42, while maintaining the spacing between adjacent sloped-tube segments 30. The diagonally extending framework 41 formed by the first support members 42 and the second support members or compression supports 44 maintains the spacing between the sloped-tube segments 30 and prevents direct contact between adjacent tube surfaces, while also supporting the serpentine tubes 28 off the first support members 42, but is not attached to the straddled sloped-tube segments 30, and is loose enough to allow the serpentine tubes 28 and the structural framework 41 to move freely in response to thermal expansion and contraction.

Although the present invention has been described above with reference to particular means, materials, and embodiments, it is to be understood that this invention may be varied in many ways without departing from the spirit and scope thereof, and therefore is not limited to these disclosed particulars but extends instead to all equivalents within the scope of the following claims.

I claim:

1. A supporting structural framework for a tubular heat exchanger having at least one bank of serpentine tubes disposed in rows spaced in side-by-side parallel relation, each of the rows including spaced and substantially coplanar elongate tube segments and return-bend tube segments, the supporting structural framework including first and second support members, the first members being paired to straddle the elongate tube segments of each of at least some of the rows and the second members extending between the elongate segments of the straddled rows, wherein some of the second members are concavo-concave blocks having recessed sides facing adjacent portions of the sloped-tube segments of the straddled row, and the first and second support members being rigidly interconnected to provide a tube supporting fit that is loose enough to permit relative movement between the tubes and the supporting structural framework due to differential thermal expansion and contraction.

2. The structural framework according to claim 1, including the recessed sides being shaped to conform to the cross sectional shape of the confronted portions of the sloped-tube segments.

3. The structural framework according to claim 1, wherein the other of said second support members are laterally extending bars.

4. The structural framework according to claim 1, wherein the elongate tube segments are sloped.

5. The structural framework according to claim 1, wherein some of the first support members are vertically extending bars.

6. The structural framework according to claim 5, wherein the other of said first support members are diagonally extending bars.

7. In combination, an on-line steam generator producing a heated flue gas stream and including a vertical passageway through which the gas stream is conveyed, a supporting structural framework for a heat exchanger having at least one bank of serpentine tubes disposed in rows within the passageway and across the gas stream in side-by-side parallel relation, means for passing a fluid to be heated through the tubes, each of the tube rows including spaced and substantially coplanar elongate tube segments and return-bend tube segments, and the structural framework including rigidly interconnected first and second support members, the first members being paired to straddle the elongate tube segments of each of at least some of the rows and the second members extending between the elongate segments of the straddled rows, and wherein some of the second support members are concavo-concave blocks having recessed sides facing adjacent portions of the elongate tube segments to provide a tube supporting fit that is loose enough to permit relative movement between the tubes and the supporting structural framework due to differential thermal expansion and contraction.

8. The combination according to claim 7, including the recessed sides being shaped to conform to the cross sectional shape of the confronted portions of the sloped-tube segments.

9. The combination according to claim 7, wherein the other of said second support members are laterally extending bars.

10. The combination according to claim 7, wherein the elongate tube segments are sloped.

11. The combination according to claim 7, wherein some of the first support members are vertically extending bars.

12. The combination according to claim 11, wherein the other of said first support members are diagonally extending bars.

13. A supporting structural framework for a tubular heat exchanger having at least one bank of serpentine tubes disposed in rows spaced in side-by-side parallel relation, each of the rows including spaced elongate tube segments and return-bend tube segments lying in a substantially common flat plane throughout their length, the supporting structural framework including first and second support members, the first members being paired to straddle the elongate tube segments of each of at least some of the rows and the second members extending between the elongate tube segments of the straddled rows, the first and second support members being rigidly interconnected to provide a tube supporting fit that is loose enough to permit movement between the tubes and the supporting structural framework due to differential thermal expansion and contraction, and wherein the first support members include vertically and diagonally extending bars, and said diagonally extending bars being adapted to transmit support loads of the heat exchanger and structural framework.

14. The structural framework according to claim 13, wherein the elongate tube segments are sloped.

15. The structural framework according to claim 13, wherein some of the second support members are concavo-concave blocks having recessed sides facing adjacent portions of the tube segments of the straddled rows.

16. The structural framework according to claim 15, including the recessed sides being shaped to conform to the cross sectional shape of the confronted portions of the tube segments.

17. The structural framework according to claim 15, wherein the other of said second support members are laterally extending bars.

18. In combination, an on-line steam generator producing a heated flue gas stream, walls defining a vertical passageway through which the gas stream is conveyed, a supporting structural framework for a heat exchanger having at least one bank of serpentine tubes disposed in rows within the passageway and across the gas stream in side-by-side parallel relation, means for passing a fluid to be heated through the tubes, each of the tube rows including spaced elongate tube segments and return-bend tube segments lying in a substantially common flat plane throughout their length, the structural framework including rigidly interconnected first and second support members to provide a tube supporting fit that is loose enough to permit relative movement between the tubes and the structural framework due to differential thermal expansion and contraction, the first support members being paired to straddle the tube segments of each of at least some of the tube rows and the second support members extending between the tube segments of the straddled tube rows, and wherein the first support members include vertically and diagonally extending bars, and said diagonally extending bars being adapted to transmit support loads of the heat exchanger and structural framework to the walls of the passageway.

19. The combination according to claim 18, wherein the elongate tube segments are sloped.

20. The combination according to claim 18, wherein some of the second support members are concavo-concave blocks having recessed sides facing adjacent portions of the tube segments of the straddled rows.

21. The combination according to claim to claim 20, wherein the recessed sides are shaped to conform to the cross sectional shape of the confronted portions of the tube segments.

22. The combination according to claim 20, wherein the other of said second support members are laterally extending bars.

* * * * *